US007050750B2

(12) United States Patent
Byun et al.

(10) Patent No.: US 7,050,750 B2
(45) Date of Patent: May 23, 2006

(54) WASTE TONER COLLECTING APPARATUS USING OPC DRUM

(75) Inventors: Seung-young Byun, Sungnam (KR); Chung-guk Baek, Suwon (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 0 days.

(21) Appl. No.: 10/437,189

(22) Filed: May 14, 2003

(65) Prior Publication Data

US 2004/0005179 A1 Jan. 8, 2004

(30) Foreign Application Priority Data

Jul. 4, 2002 (KR) ..... 2002-38693

(51) Int. Cl.
*G03G 21/12* (2006.01)
*G03G 21/00* (2006.01)

(52) U.S. Cl. ..... 399/360; 399/358

(58) Field of Classification Search ..... 399/116, 399/123, 343, 358, 360
See application file for complete search history.

(56) References Cited

U.S. PATENT DOCUMENTS 4,593,997 A * 6/1986 Fox et al. ..... 399/360
5,030,988 A * 7/1991 Haneda et al. ..... 399/358 X
5,065,195 A * 11/1991 Haneda et al. ..... 399/358 X
5,146,270 A * 9/1992 Matsuo et al. ..... 399/358 X
5,250,989 A * 10/1993 Morita et al. ..... 399/358 X
5,309,211 A * 5/1994 Yoshioka ..... 399/113
5,526,100 A * 6/1996 Misago et al. ..... 399/358 X
5,778,296 A * 7/1998 van der Steen et al. .... 399/360
5,933,696 A * 8/1999 Howard et al. ..... 399/360
6,308,017 B1 * 10/2001 Taniyama et al. ..... 399/358 X

FOREIGN PATENT DOCUMENTS

JP 08-101614 * 4/1996

* cited by examiner

*Primary Examiner*—Sandra L. Brase
(74) *Attorney, Agent, or Firm*—Staas & Halsey LLP

(57) ABSTRACT

A waste toner collecting apparatus using a disposable OPC drum utilizes an inside space of the disposable OPC drum as a waste toner container to collect waste toner. The waste toner collecting apparatus comprises a waste toner removing unit contacting one side of the OPC drum to remove the waste toner from the OPC drum, first transport unit transporting the waste toner, which is removed by the waste toner removing unit from the OPC drum, in one direction, a second transport unit transporting waste toner, which is transported by the first transport unit, to one side of a storage unit, and a screw member moving the waste toner, which is moved to one side of the storage unit, to the other side of the storage unit to store the waste toner within the storage unit from the one side to the other side without leaving an unused hollow space. A user can conveniently remove the waste toner by replacing only the OPC drum instead of individually replacing the OPC drum and the waste toner container.

15 Claims, 4 Drawing Sheets

WASTE TONER COLLECTING APPARATUS USING OPC DRUM

CROSS-REFERENCE TO RELATED APPLICATIONS

This application claims the benefit of Korean Patent Application No. 2002-38693, filed Jul. 4, 2002, in the Korean Intellectual Property Office, the disclosure of which is incorporated herein by reference.

BACKGROUND OF THE INVENTION

1. Field of the Invention

The present invention relates to a waste toner collecting apparatus comprising a waste toner container which is inserted into an OPC drum so that waste toner can be removed simultaneously with replacement of an OPC unit without causing any inconvenience of replacing an additional waste toner container, and a restricted inside space of the OPC drum can be efficiently used.

2. Description of the Related Art

Throughout the description of this specification, a term 'toner' will be referred to as a 'developer' used in image developing systems.

After being transferred to a developing roller of an image developing system, toner is moved to an OPC drum in general. Then the toner is transferred from image regions of the OPC drum into an image carrier belt.

The toner transferred to the image carrier belt is moved into a print sheet to form an image. On the other hand, the toner attached to non-image regions of the OPC drum remains on the OPC drum as waste toner, which will be removed by a waste toner collecting apparatus.

FIGS. 1 and 2 are perspective views of a conventional waste toner collecting apparatus. As shown in FIGS. 1 and 2, the conventional waste toner collecting apparatus includes a cleaning blade 80 installed in one side of an OPC drum 86 on an OPC unit 81 in a tightly contacting manner, an auger 82 disposed under the cleaning blade 80, and a waste toner container 83 installed under the auger 82 and separated from the OPC unit 81.

The waste toner is separated from the OPC drum 86 by the cleaning blade 80 to drop to the auger 82 by gravity. The waste toner dropped to the auger 82 is transferred toward the waste toner container 83, i.e. toward a shutter 84, along an arrow shown in FIG. 2 by the auger 82, and then drops into the waste toner container 83.

Where the waste toner collected as above fills the waste toner container 83 to be full, a sensor (not shown) informs a user that a quantity of the waste toner fills the waste toner container 83 so that the user can replace the waste toner container 83. The shutter 84 presses an entrance (not shown) of the waste toner container 83 in installation of the OPC unit 81 so as to open the entrance of the waste toner container to receive the waste toner.

In the related art as set forth above, the user is inconveniently required to replace the disposable OPC unit as well as the waste toner container. Also the waste toner container occupies a partial space of the image developing system accordingly increasing a volume thereof as a drawback.

Furthermore, in order to overcome the above drawbacks, recent technologies improving the waste toner collecting apparatus are developed to use an inside space of the OPC drum. However, these technologies only transfer the waste toner into a storage unit disposed inside the OPC drum and then stack the same in one side thereof thereby failing to sufficiently utilize a storage space of the storage unit. These technologies are disclosed, for example, in Japanese Laid-Open Patent Publication Nos. H10-161503 and H4-127186.

SUMMARY OF THE INVENTION

Accordingly, the present invention has been made to solve the above and other problems, and it is an object of the present invention to provide a waste toner collecting apparatus which utilizes an inside space of a disposable OPC drum as a waste toner container allowing waste toner to be collected into the inside space to be simultaneously removed with the OPC drum to enhance convenience of a user.

It is another object of the invention to provide a waste toner collecting apparatus using an OPC drum which properly stores waste toner inside the OPC drum from one side without any unused space to efficiently use a storage space.

It is another object of the invention to provide a waste toner collecting apparatus using an OPC drum which can reduce a volume of an image developing apparatus as much as a volume of a waste toner container.

Additional objects and advantageous of the invention will be set forth in part in the description which follows and, in part, will be obvious from the description, or may be learned by practice of the invention.

According to an aspect of the invention to achieve the above and the other objects, a waste toner collecting apparatus collecting waste toner by using an inside space of an OPC drum of an image developing system as a storage unit is provided. The waste toner collecting apparatus includes a waste toner removing unit contacting the OPC drum to remove the waste toner from the OPC drum, a first transport unit transporting the waste toner, which is removed by the waste toner removing unit, in a direction, a second transport unit transporting waste toner, which is transported by the first transport means, to one side of the storage unit, and a screw member moving the waste toner, which is moved to one side of the storage unit, from the one side to the other side of the storage unit to store the waste toner within the storage unit from the one side to the other side without leaving an unused space in the storage unit.

It is possible that the waste toner removing unit inlcudes a plate-like cleaning blade made of rubber.

It is possible that the first transport unit includes a first duct which is installed in one side of the waste toner removing unit and a first auger which is disposed within the first duct to transport the waste toner to one side of the first duct.

It is possible that the first transport unit comprises a toner pushing unit which is installed within the first duct to push the waste toner toward the first auger.

According to another aspect of the present invention, the toner pushing unit may comprise a sweep roller shaped as an elliptical roller.

It is also possible that the second transport unit comprises a second duct connected to one end of the first duct, a hollow shaft disposed in one side of the OPC drum and connected to one side of the second duct, and a second auger disposed inside the hollow shaft to transport the waste toner to the storage unit.

BRIEF DESCRIPTION OF THE DRAWINGS

The above and other objects, features and other advantages of the present invention will become apparent and more readily appreciated from the following description of the preferred embodiments, taken in conjunction with the accompanying drawings, in which.

DETAILED DESCRIPTION OF THE PREFERRED EMBODIMENTS

Figure 1:
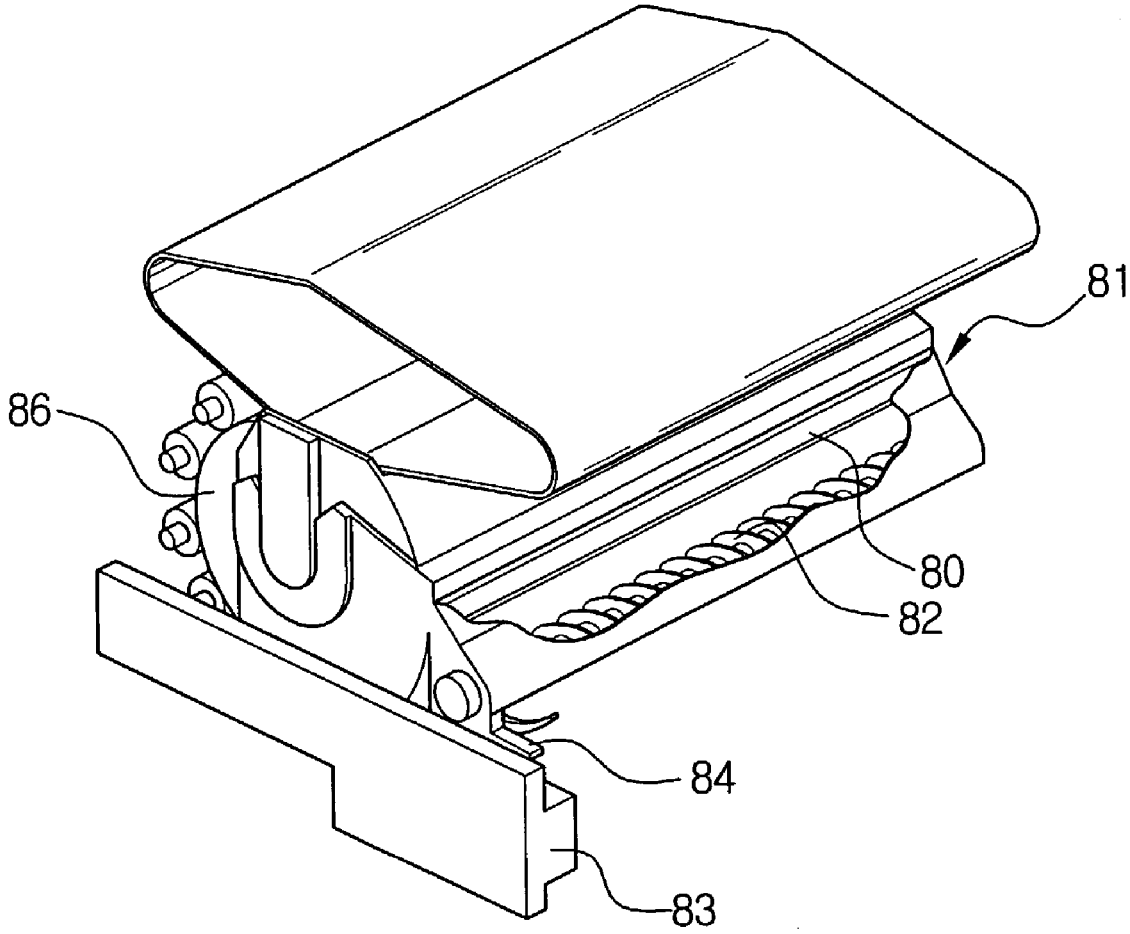
FIG. 1 (PRIOR ART)
FIG. 1 is a perspective view of a conventional waste toner collecting apparatus having an OPC unit.
Figure 2:
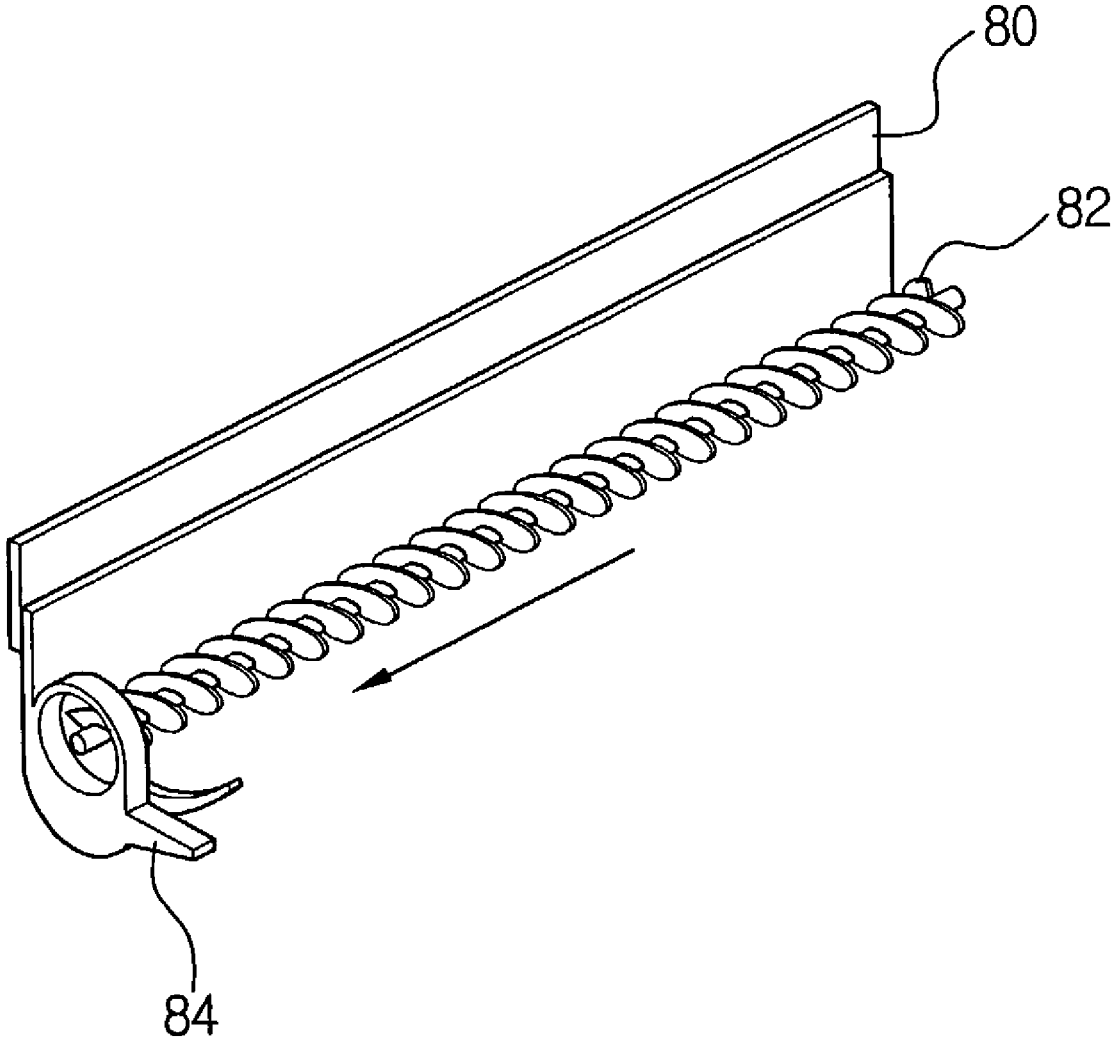
FIG.2 (PRIOR ART)
FIG. 2 is a perspective view of a cleaning blade, an auger, and a shutter of the waste toner collecting apparatus shown in FIG. 1.

Reference will now be made in detail to the present preferred embodiment of the present invention, examples of which are illustrated in the accompanying drawings, wherein like reference numerals refer to the like elements throughout. The embodiment is in order to explain the present invention by referring to the figures.

The following detailed description will present a preferred embodiment of the invention in reference to the accompanying drawings.

Figure 3:
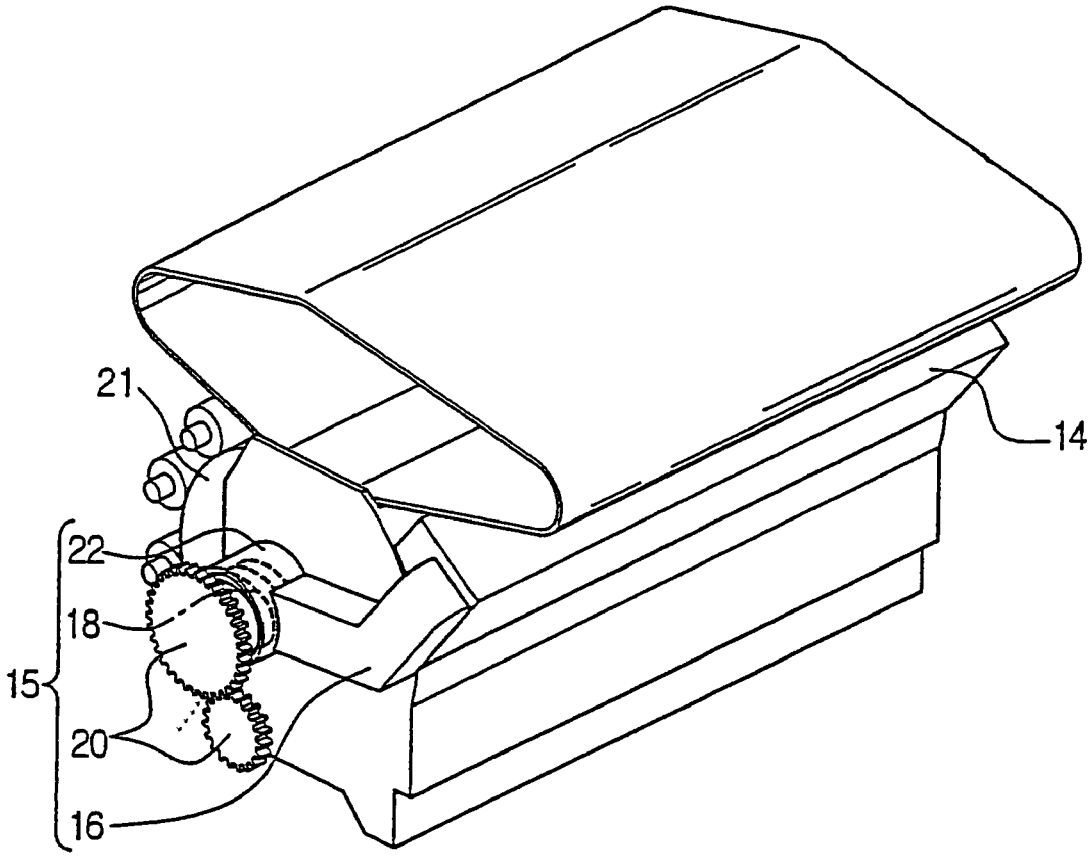
FIG. 3 is a perspective view illustrating a waste toner collecting apparatus according to an embodiment of the invention.
Figure 4:
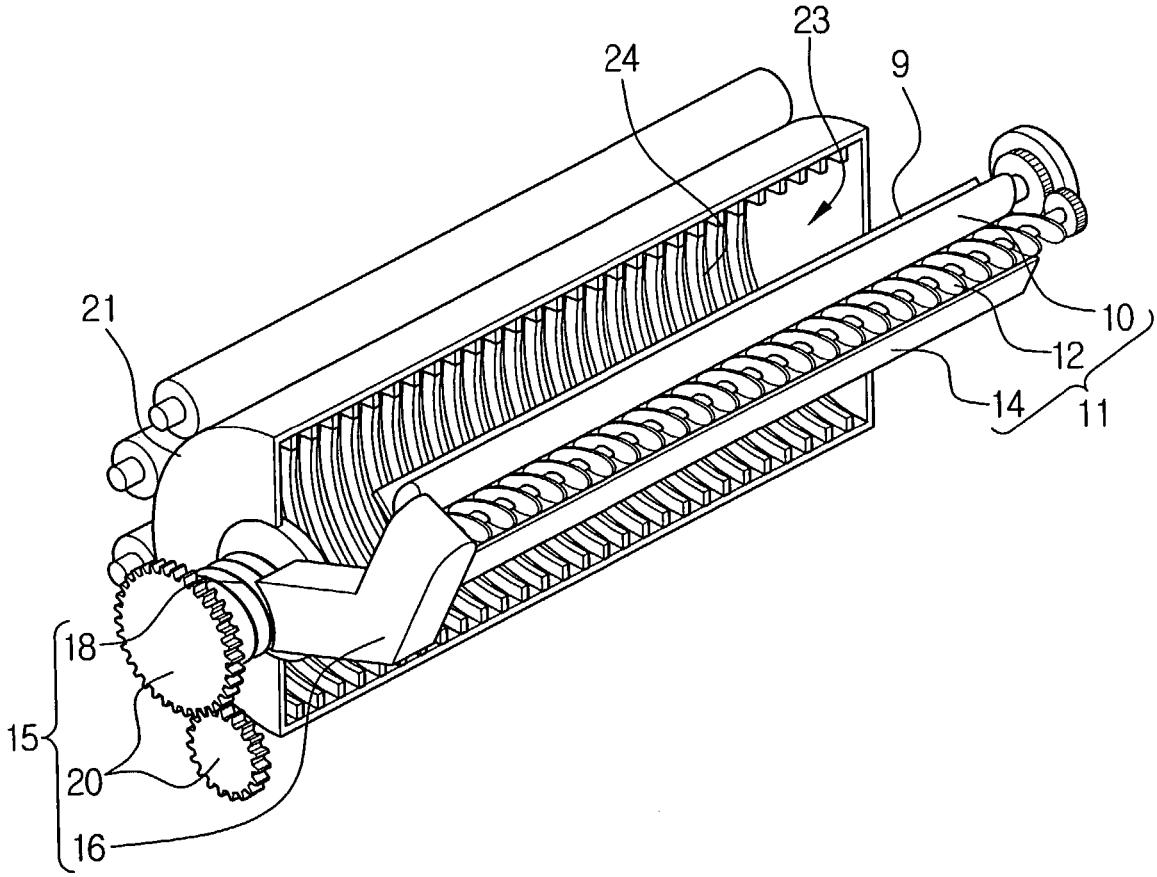
FIG. 4 is a partially broken perspective view illustrating internal components of the waste toner collecting apparatus shown in FIG. 3.

FIG. 3 is a perspective view of a waste toner collecting apparatus using an OPC drum 21 according to an embodiment of the invention, and FIG. 4 is a partially broken perspective view of the waste toner collecting apparatus shown in FIG. 3.

As shown in FIGS. 3 and 4, the waste toner collecting apparatus using the OPC drum 21 comprises a cleaning blade 9 contacting the OPC drum 21 to scrape waste toner from the OPC drum 21, an elliptical sweep roller 10, a first auger 12 disposed on a side of the sweep roller 10, a first duct 14 surrounding the sweep roller 10 and the first auger 12, a second duct 16 connected to one side of the first duct 14, a hollow shaft 22 of the OPC drum 21 connected to one side of the second duct 16, a driving gear 20 driving the second auger 18, and a storage unit 23 installed within the OPC drum 21.

In the waste toner collecting apparatus as described above, a waste toner removing unit comprises the cleaning blade 9, and a first transport unit 11 comprises the sweep roller 10, the first auger 12, and the first duct 14 surrounding the sweep roller and the first auger 12.

Also, a second transport unit 15 comprises the second duct 16 and the second auger 18, the hollow shaft 22 of the OPC drum 21 and the driving gear 20. The storage unit 23 has a screw member 24 installed within the OPC drum 21.

An operation of the waste toner collecting apparatus is described as follows. Waste toner is removed from the OPC drum by the cleaning blade 9 being in tight contact with the OPC drum 21 and obliquely disposed with respect to the OPC drum 21. The removed waste toner is stacked under the cleaning blade 9, and pushed by the sweep roller 10 toward the first auger 12.

After moved to the first auger 12 as described above, the waste toner is pushed to the one side of the first duct 14 by the first auger 12 which is rotated by an engagement with the sweep roller 10, and then freely drops into the second duct 16 by gravity. The dropping waste toner falls into one side of the OPC drum 21 by the second auger 18 which is installed inside the hollow shaft 22.

After the waste toner is pushed into one end of an inside space of the OPC drum, the screw member 24 installed in the storage unit 23 within the OPC drum 21 moves the waste toner to properly stack the waste toner in the inside space of the OPC drum 21 from the one end of the storage unit 23 to the other end thereof.

In the waste toner collecting apparatus using the OPC drum 21, the waste toner is collected into the inside space of the OPC drum without any additional waste toner container. Then, a user can conveniently remove the waste toner by replacing only the OPC drum with a new one instead of individually replacing the OPC drum and the waste toner container.

Also, the waste toner collecting apparatus using the OPC drum comprises the waste toner storage unit which can properly stack the waste toner in the inside space of the OPC drum from one end thereof so as to efficiently utilize the restricted inside space of the OPC drum.

Furthermore, the invention can reduce a volume of an image developing system by omitting an external conventional waste toner container.

Although the present invention has been shown and described as above with reference to certain preferred embodiments thereof, it is not intended that the invention is restricted by the construction and operation as set forth above. It will be understood by those skilled in the art that various changes may be made therein without departing from the spirit and scope of the invention as defined by the appended claims and their equivalents. Other modifications, variations, and equivalents of the present invention may be made within the scope of the invention.

What is claimed is:

1. A waste toner collecting apparatus collecting waste toner from an OPC drum in an image developing system, comprising:

a waste toner removing unit contacting the OPC drum to remove the waste toner from an OPC drum;

a storage unit disposed in an inside of the OPC drum;

a transport unit transporting the waste toner to one side of the storage unit, which is removed by the waste toner removing unit;

a screw member formed on an inner surface of the OPC drum, and wherein the transport unit comprises a toner pushing unit which is installed within a duct to push the waste toner toward an auger.

2. The waste toner collecting apparatus according to claim 1, wherein the transport unit comprises;

a first transport unit for transporting waste toner in one direction, which is removed by the waste toner removing unit; and a second transport unit for transporting waste toner, which is transported by the first transport unit, to one side of the storage unit.

3. The waste toner collecting apparatus according to claim 2, wherein the duct comprises a first duct and a second duct, the auger comprises a first auger and a second auger, and wherein first transport unit comprises:

the first duct which is installed in one side of the waste toner removing unit; and the first auger which is disposed within the first duct to transport waste toner to one side of the first duct, and wherein the second transport unit comprises:

the second duct connected to one end of the first duct;

a hollow shaft disposed in one side of the OPC drum and connected to one side of the second duct; and the second auger disposed inside the hollow shaft to transport the waste toner to the storage unit.

4. The waste toner collecting apparatus according to claim 1, wherein the toner pushing unit comprises:

a sweep roller shaped as an elliptical roller.

5. The waste toner collecting apparatus of claim 1, wherein the OPC drum and the storage unit are formed in an integral body simultaneously mounted in the image developing system and simultaneously removed from the image developing system.

6. The waste toner collecting apparatus of claim 1, wherein the screw member transports the waste toner, which is moved to the one side of the storage unit, to the other side of the storage unit to store the waste toner from the one side to the other side of the storage unit.

7. A method of collecting waste toner in a waste toner collecting apparatus of an image developing system, the method comprising:

transporting the waste toner removed from an OPC drum containing a storage unit toward a first side of the storage unit disposed in an inside of the OPC drum using a transport unit disposed in a longitudinal direction of the OPC drum and in a radial direction of the OPC drum;

moving the waste toner from the first side of the storage unit to a second side of the storage unit by a screw member formed on an inner surface of the OPC drum, and pushing the waste toner toward an auger via a toner pushing unit installed within a duct and which is included in the transport unit.

8. The method of claim 7, wherein the transporting of the waste toner comprises:

transporting the waste toner in the longitudinal direction of the OPC drum; and transporting the waste toner in a radial direction of the OPC drum.

9. The waste toner collecting apparatus of claim 7, wherein the screw member accumulates the waste toner in the first side of the storage unit toward the second side of the storage unit through the inside surface of the OPC drum.

10. A waste toner collecting apparatus collecting waste toner in an image developing system, comprising:

an OPC drum which has an inner surface formed screw member, a waste toner removing unit contacting the OPC drum to remove the waste toner from the OPC drum;

a storage unit disposed in an inside of the OPC drum;

a transport unit transporting the waste toner to one side of the storage unit, which is removed by the waste toner removing unit, and wherein the transport unit comprises a toner pushing unit which is installed within a duct to push the waste toner toward an auger.

11. The waste toner collecting apparatus of claim 10, wherein the screw member transports the waste toner, which is moved to the one side of the OPC drum, to the other side of the OPC drum to store the waste toner from the one side to the other side of the OPC drum when the OPC drum rotates.

12. The waste toner collecting apparatus according to claim 10, wherein the transport unit further comprises:

a first transport unit for transporting waste toner in one direction, which is removed by the waste toner removing unit;

a second transport unit for transporting waste toner, which is transported by the first transport unit, to one side of the OPC drum.

13. A waste toner collecting apparatus collecting waste toner in an image developing system, comprising:

an OPC drum comprising an image developing portion and a threaded waste toner storage portion; and a transport unit transporting the waste toner to the OPC drum, and wherein the transport unit comprises a toner pushing unit which is installed within a duct to push the waste toner toward an auger.

14. The waste toner collecting apparatus according to claim 13, wherein the image developing portion and the threaded waste toner storage portion are integrally manufactured as a single body.

15. The waste toner collecting apparatus according to claim 13, wherein the threaded waste toner storage portion is separately formed from the image developing portion.

* * * * *